United States Patent [19]

Mellard

[11] 4,089,460

[45] May 16, 1978

[54] MAILBOX SIGNAL

[76] Inventor: George K. Mellard, R.D. 2, Box 63 Duerer St., Egg Harbor City, N.J. 08215

[21] Appl. No.: 677,397

[22] Filed: Apr. 15, 1976

[51] Int. Cl.[2] ..... B65B 91/00

[52] U.S. Cl. ..... 232/34

[58] Field of Search ..... 232/34, 35

[56] References Cited

U.S. PATENT DOCUMENTS

| | | | |
|---|---|---|---|
| 932,547 | 8/1909 | Hess | 232/34 |
| 969,038 | 8/1910 | Carmony | 232/34 |
| 1,262,816 | 4/1918 | Lucas | 232/34 |
| 1,315,914 | 9/1919 | Dubbs | 232/34 |
| 1,334,106 | 3/1920 | Mackey | 232/34 |
| 1,990,003 | 2/1935 | Schlenker | 232/35 |
| 2,801,046 | 7/1957 | Mirkin | 232/34 |
| 2,985,360 | 5/1961 | Stapleton | 232/35 |
| 3,675,845 | 7/1972 | Scheerer | 232/35 |
| 3,891,139 | 6/1975 | Redling | 232/35 |

*Primary Examiner*—Roy D. Frazier
*Assistant Examiner*—Peter A. Aschenbrenner
*Attorney, Agent, or Firm*—Ashlan F. Harlan, Jr.

[57] ABSTRACT

A rural type mailbox having a pivoted platform therein. The platform is tilted from a manually set, metastable position to a stable position by shiftable weights when an article of mail, such as a letter is placed thereon. Such tilting, through a magnetic coupling and levers causes a signal target to be raised into view whereby the owner of the box is informed that mail has been deposited therein.

9 Claims, 4 Drawing Figures

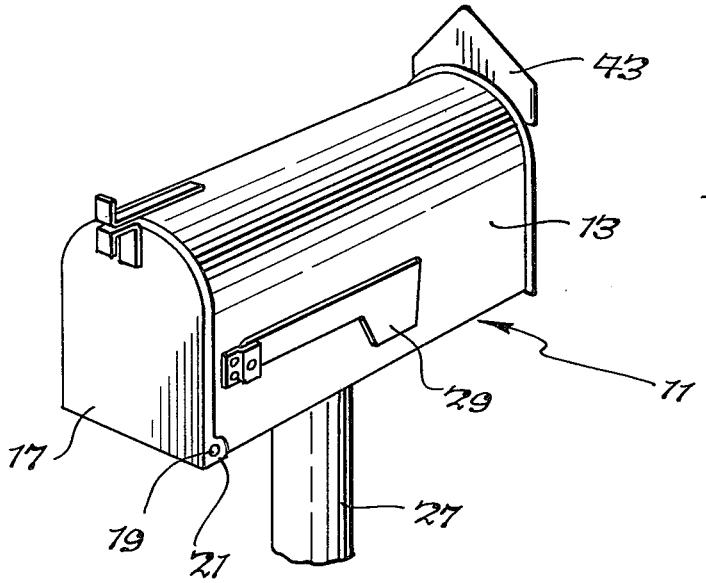
Fig. 1.
Fig. 2.
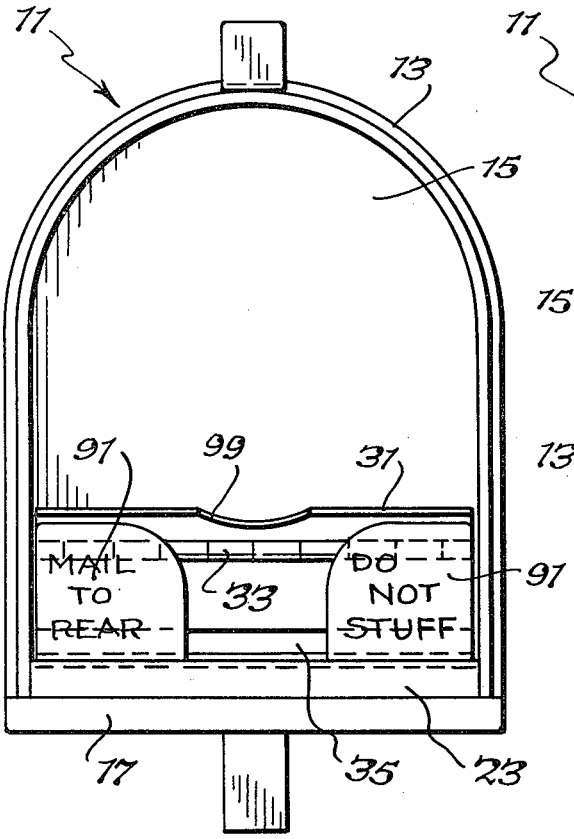
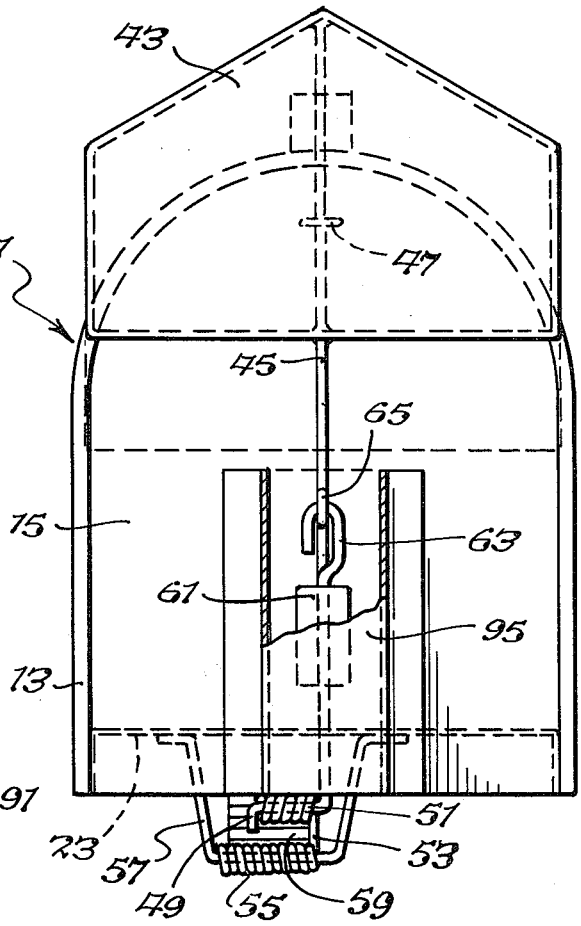
Fig. 3.

MAILBOX SIGNAL

BACKGROUND OF THE INVENTION

The invention of the present application relates to mailboxes of the rural type and is particularly concerned with a signal associated with such a mailbox which will inform the owner of the mailbox that mail has been deposited therein.

It is common for mailboxes in rural areas to be located at a considerable distance from the residence of the owner. Since it is unfeasible to keep a continuous watch on the box and since a comparatively long trip will be required, where the distance from the highway to the house is great, to determine whether mail has been delivered, it is desirable to have means whereby a resident can be informed that mail has been placed in his mailbox by the mail carrier.

A number of devices are known for conveying such information to the box owner. Among these are those shown in U.S. Pat. Nos. 2,670,897 and 3,026,024. However, many such devices require some positive extra action on the part of the mail carrier or are so constructed as to be easily damaged or require frequent adjustment. Accordingly, it is desirable to provide a mailbox with means for signaling that the box contains mail, which means will maintain its adjustment, will be protected from damage, and will not require any action by the mail carrier other than placing the mail in the box.

SUMMARY OF THE INVENTION

The present invention provides novel means that can be attached to an existing rural type mailbox, or can be built into such a box, which will indicate to the box owner that mail, even a single piece of mail, has been deposited therein by the mail carrier. The means comprises a movable signaling device, visible from a distance, outside the mailbox which is connected to and operated by a pivoted plate or platform within the box. The plate or platform is weighted and provided with rolling means whereby to shift the balance thereof so that, under the weight of only a single letter placed on the plate adjacent the rear of the box, the plate will pivot from a forwardly inclined position to a position in which the rear of the plate is depressed. The connection between the plate and the signaling device comprises two permanent magnets arranged with like poles facing. One magnet is mounted on the bottom of the pivoted plate near the rear end thereof and the other is carried by one end of a lever, the other end of which is operatively attached to a vertical rod carrying a signal target on the upper end thereof. Thus, when the rear end of the plate moves downwardly, the repulsion between the magnets causes the signal target to move upwardly into view. A weight may be provided to assist in retracting or lowering the target when the plate is reset, with the rear end thereof elevated, after the mail is removed from the mailbox.

SHORT DESCRIPTION OF THE DRAWINGS

FIG. 1 is a perspective view of a rural type mailbox provided with a signaling device according to the present invention shown mounted on a post;

FIG. 2 is a front view of the mailbox illustrated in FIG. 1 with the door of the box shown open;

FIG. 3 is a rear view of the mailbox illustrated in FIG. 1 showing details of the signal.

DESCRIPTION OF THE INVENTION

Figure 4:
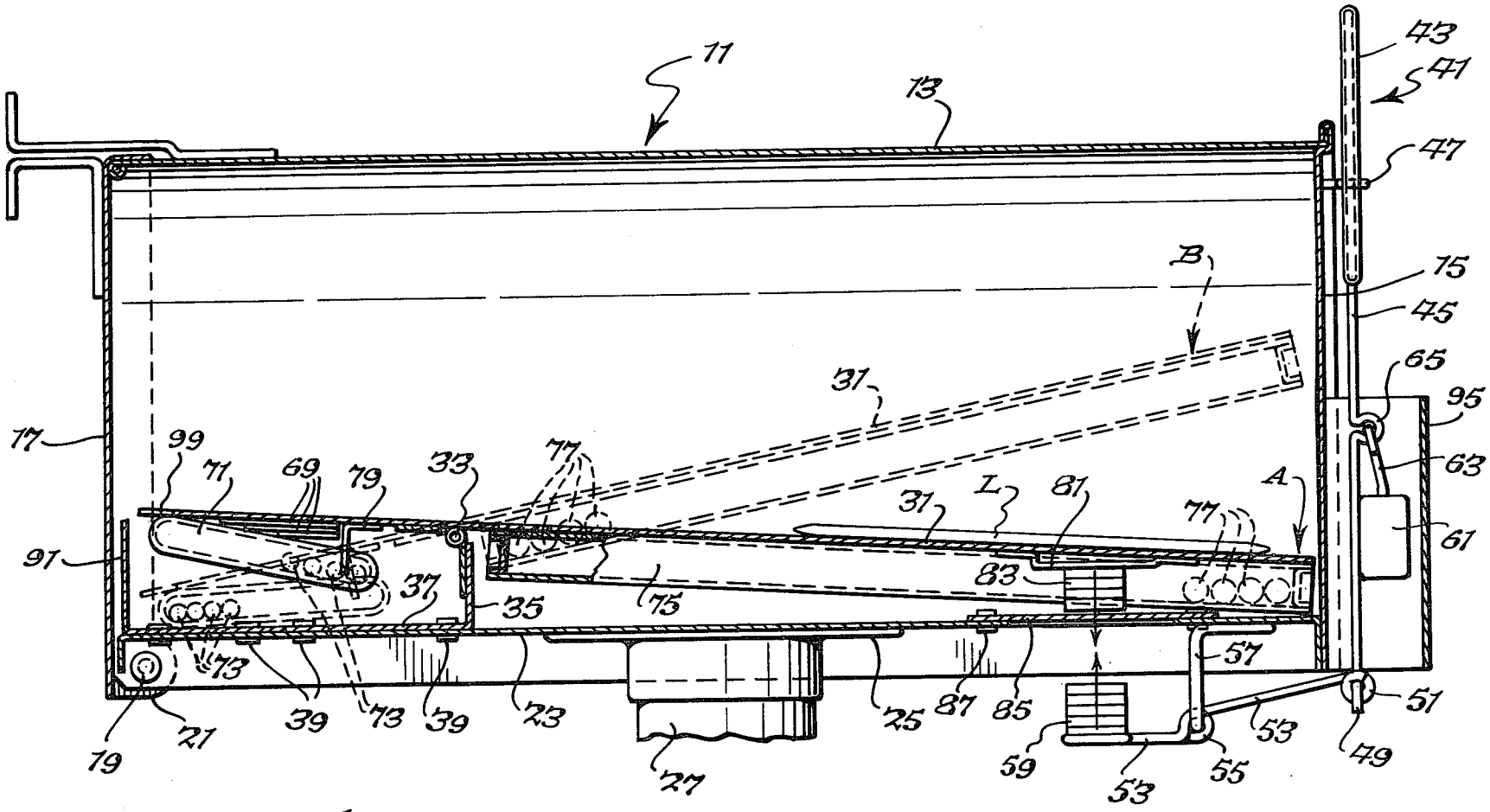
FIG. 4 is a longitudinal, vertical sectional view of the mailbox illustrated in FIG. 1.

The terms "upper", "lower", "top", "bottom", "right", "left", "above", "below", "vertical", "horizontal", and similar terms of position and/or direction as used hereinafter refer to the illustrations in the figures of the drawing, but are used only for convenience in description and/or reference. Such terms should not be so construed as to imply a necessary positioning of the structure or portions thereof or to limit the scope of this invention.

FIG. 1 shows, in perspective, a typical rural type mailbox, comprehensively designated 11, which comprises an elongated body portion 13 having a back 15 and, on its front, a vertically swinging door 17. The door 17 is pivotally mounted, adjacent the lower front end of the body portion 13, on a rod 19 by ears 21. The box 11 may be supported in any suitable manner, e.g. by securing the bottom 23 of the body portion 13 by suitable means such as bolts (not shown) to a plate 25 carried on the upper end of a post 27, the lower end of which can be secured in the ground. As shown in FIG. 1, the mailbox 11 may be provided with the conventional pivoted flag 29 used to inform the mail carrier that the box contains mail for posting.

The novel features of the present invention are most clearly shown in FIG. 4. It will be seen there that in the interior of the box 11 there is provided a plate or platform 31 which functions as a false bottom. Intermediate its ends, but nearer its front end, the plate 31 is pivotally mounted for vertical oscillating motion on a transverse hinge 33 secured by suitable means (not shown) to said plate and to an upwardly extending flange 35 of a bracket 37. The latter is suitably secured, as by rivets 39, to the bottom or floor 23 of the mailbox 11 adjacent the front of the box. The plate 31 is preferably of a length and a uniform width slightly less than the interior length and width of the box 11 and, as shown in FIG. 4, may occupy the stable position illustrated therein in solid lines and designated A or, by means of devices hereinafter described, may be held in a metastable position illustrated in broken lines and designated B.

At the rear of the mailbox 11 there is mounted a signal, designated generally 41. The signal comprises a target 43 which may be of metal or any other suitable material, attached to and carried on a rod, e.g. a length of heavy wire 45, that is held in vertical position for reciprocation by a guide 47 suitably secured to the back 15 of the box 11. The lower end of the wire 45 is bent laterally, as shown at 49, and preferably has, surrounding the bent end, a wire coil 51 formed on one end of a lever 53 that may be made of stiff wire. Intermediate its ends, the wire of the lever 53 is formed with a coil 55 that encircles a bracket or hanger 57, which also may be formed of wire, that depends from and is attached by suitable means to the bottom 23 of the box 11. A permanent magnet 59 is supported on the other end of the lever 53 to which it is secured in any suitable manner. The coil 55 and coil 51 fit loosely around the rod end 49 and the hanger 57, respectively, whereby the lever 53 is pivotally connected at two points. The target 43 is thus movable vertically by movement of the magnet 59, transmitted by the lever 53 and the rod 45. To bias the target into a lowered, or retracted, position a weight 61 may be provided. This weight preferably carries a hook 63 which is detachably received in a loop 65 formed in the rod 45.

The plate 31 is pivotally mounted between the middle and the front end thereof. Accordingly, it tends to slope downwardly toward the rear end of the box 11 and to occupy the position shown in solid lines in FIG. 4, and designated A. However, means is provided for overcoming this tendency and causing the plate 31 to slope upwardly in the metastable position shown in broken lines in FIG. 4 and there designated B. Such means comprises one or more counterweights 69 and a pair of longitudinally spaced balance tubes 71 and 75 each containing longitudinally shifting weights, e. g. a plurality of rolling balls 73 and 77, respectively, or a small amount of liquid, preferably a heavy liquid such as mercury.

The front, smaller, balance tube 71 is mounted longitudinally on the lower side of the plate 31 adjacent the front end of the plate. It is supported in inclined position with respect to the plate, by suitable means such as a bracket 79 suitably attached, for example by adhesive, to both the plate 31 and the tube 71. The larger balance tube 75 is mounted rearwardly of the hinge 33 parallel with the plate 31 and on the lower surface thereof. Any suitable means for mounting the tube 75 may be used, for example an adhesive.

Also carried on the lower side of the platform or plate 31, adjacent the rear end thereof, is a bracket 81 to which there is attached, by suitable means, a permanent magnet 83. The magnet 83 is aligned with the magnet 59 carried by the wire lever 53 and is positioned so that the opposing faces of the two magnets have the same polarity, thus providing a repulsive or opposing force between them as shown by the arrows in FIG. 4. Consequently, when the magnet 83 approaches the magnet 59 the latter is repulsed and causes swinging of the lever 53 and upward movement of the rod 45 to raise the signal target 43. Upon upward motion of the upper magnet 83, when the plate 31 tilts upwardly to position B, the magnet 59 also moves upwardly, since the repulsive force is reduced, to permit retraction of the signal target 43 from its signalling position. To prevent magnetic interference from the bottom 23 of the mailbox 11, which is in many cases formed of steel, a portion of the bottom is cut out in the area proximate to the magnets, the resulting hole being covered by a sheet 85 of suitable nonmagnetic material, such as aluminum or a suitable plastic, that is held in place by suitable means such as rivets 87.

The operation of the above-described device is, as explained below, simple and reliable. When the mailbox has been emptied by the owner, the latter depresses the front end of the plate 31 until it assumes metastable position B. In this position the front balance tube 71 is, as shown in FIG. 4, inclined slightly downwardly toward the front of the box with the balls 73 therein located at the front end of the tube; and the rear balance tube 75, which is parallel with the plate 31, also slopes downwardly toward the front of the box with the balls 77 positioned at the front end of the tube. As stated, the plate 31 is metastable in position B, i.e. it will remain in the position but only a slight force is necessary to return it to the stable position, A. When mail, for example a letter L, is deposited in the box 11 by the mail carrier, it is placed in the rear portion of the box, in accordance with the admonition of the indicia carried on the front upwardly extending flange 91 of the bracket 37. When so deposited, the weight of the letter L is sufficient to cause the plate 31 to pivot clockwise, as shown in FIG. 4. Only a small movement of the plate is sufficient to tilt the balance tube 71 enough to cause the balls 73 therein to roll to the rear end of the tube, thus changing the center of balance of the assembly enough to cause further tilting of the plate. When the plate pivots only slightly past dead center, i.e. a level position, the balls 77 in the balance tube 75 roll rearwardly in the tube, thus further shifting the center of gravity of the assembly to the rear whereby the plate 31 is quite stable in position A until it is reset after the letter L is removed.

As explained above, the permanent magnet 83 tends to repulse the magnet 59 so that the signal target 43 is automatically raised to signaling position when the plate 31 with mail thereon occupies position A. When the box is reset by pivoting the plate to position B, the repulsive force on the magnet 59 is reduced and the target is retracted by action of its own weight and that of the weight 61.

To protect the moving parts of the mechanism outside the mailbox it is preferred to provide a cover 95 which may be secured in any suitable manner to the outer side of the back 15 of the box 11. Such a cover tends to prevent tampering with the weight 61 and accumulation of ice thereon during a storm. The lever 53 and magnet 59, lying under the body 13 of the box 11, are in a protected position, but if desired a suitable cover therefor can be provided.

It will be seen that the invention of the present application provides convenient and simple means for signaling a mailbox owner that mail has been deposited in the box. As above described, the mechanism does not materially reduce the capacity of the mailbox and no substantial obstruction is encountered in placing mail therein or removing it since the top surface of the plate 31 has no projections. Also, the weight of the signal target, aided if desired and/or necessary by the depending weight 61, automatically retracts the target when the plate 31 is restored to metastable position B after mail is removed from the box. Such removal may be rendered easier by providing a cut-out portion 99 on the front edge of the plate 31.

Obviously, modifications can be made in the structure shown and described above without departing from the spirit of the present invention. Thus, the weights 69 may vary in number, size and specific gravity to provide the desired sensitivity. Indeed, if desired, the plate 31 can be so formed that it has a greater mass adjacent the front end thereof than adjacent the rear end. Also, the number and size of the rolling balls 73 and 75 may vary depending on the specific gravity of the material from which they are formed. Further, the size, shape, and color of the signal target, its material, and the way in which it is actuated may be varied as desired. For example, other types of suitable levers and lever systems can be employed and, if desired, the target may be mounted for pivoted instead of rectilinear movement.

Consequently, it is desired that the present invention shall be limited only by the terms of the appended claims and shall not be construed as limited to the particular construction illustrated and described herein.

I claim:

1. A signaling device for indicating the presence of mail in a rural-type mailbox having a horizontal bottom and an end door with which said device has no operative cooperation, said device comprising: a generally horizontal plate in said mailbox adapted to support mail placed in said mailbox, said plate being adjacent to said bottom; pivot means, adjacent said door, for pivotally supporting said plate for movement about a horizontal axis extending crosswise of said mailbox, said plate extending rearwardly substantially to the rear end of said mailbox whereby it normally assumes a stable position in which it slopes downwardly toward the rear end thereof; movable means carried on the lower surface of said plate adapted in one position to hold said plate in said stable position and shiftable, when said plate is inclined downwardly toward its front, to bias said plate to said lattermentioned position; a signal target wholly without said mailbox and movable from a non-signaling position to a signaling position; and means responsive to pivotal movement of said plate to said stable position for moving said target to signaling position.

2. A signaling device as defined in claim 1 wherein said movable means comprises a rolling ball arranged for movement longitudinally of said plate.

3. A signaling device as defined in claim 2 wherein said movable means comprises a pair of tubes each containing a rolling ball, said tubes being carried on opposite sides of said pivot means and extending longitudinally of said plate and said tubes being adapted to be tilted as said plate pivots.

4. A signaling device as defined in claim 1 wherein said means for moving said signal target comprises magnets.

5. A signaling device as defined in claim 1 wherein said signal target is vertically movable.

6. A signaling device as defined in claim 1 wherein said target is retracted from said signaling position when said plate is moved to its second-mentioned position.

7. A signaling device as defined in claim 1 wherein said movable means comprises rolling balls that are enclosed in longitudinally spaced tubes and are adapted to roll longitudinally of said plate, and wherein said signal target is vertically movable to said signaling position and is retracted from said position when said plate is moved to its second-mentioned position.

8. A signaling device as defined in claim 7 wherein the weight of mail on said plate causes said plate to move from its second-mentioned position to a stable position.

9. A signaling device as defined in claim 8, wherein, in said stable position of said plate said signal target is raised to signaling position by magnetic repulsion between a magnet carried by said plate and a magnet operatively attached to said target.

* * * * *